US010605506B2

(12) United States Patent
Kihara et al.

(10) Patent No.: US 10,605,506 B2
(45) Date of Patent: Mar. 31, 2020

(54) HEAT PUMP

(71) Applicant: Yanmar Co., Ltd., Osaka-shi, Osaka-fu (JP)

(72) Inventors: Hirotoshi Kihara, Osaka (JP); Keiji Sugimori, Osaka (JP); Sadanori Yasuda, Osaka (JP); Hirotaka Nakamura, Osaka (JP); Makoto Asai, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/559,024

(22) PCT Filed: Mar. 11, 2016

(86) PCT No.: PCT/JP2016/057839
§ 371 (c)(1),
(2) Date: Sep. 15, 2017

(87) PCT Pub. No.: WO2016/148078
PCT Pub. Date: Sep. 22, 2016

(65) Prior Publication Data

US 2018/0080694 A1 Mar. 22, 2018

(30) Foreign Application Priority Data

Mar. 17, 2015 (JP) ..... 2015-053177

(51) Int. Cl.
*F25B 49/02* (2006.01)
*F25B 1/00* (2006.01)
(Continued)

(52) U.S. Cl.
CPC ..... *F25B 49/02* (2013.01); *F25B 1/00* (2013.01); *F25B 43/006* (2013.01); *F25B 43/02* (2013.01);
(Continued)

(58) Field of Classification Search
CPC .. F25B 2313/0253; F25B 13/00; F25B 43/02; F25B 43/006; F25B 49/02; F25B 49/005;
(Continued)

(56) References Cited

U.S. PATENT DOCUMENTS 3,577,741 A 5/1971 Shaw
4,236,379 A * 12/1980 Mueller ..... F25B 49/02 417/32
(Continued)

FOREIGN PATENT DOCUMENTS

CN 1122435 A 5/1996
CN 1487247 A 4/2004
(Continued)

OTHER PUBLICATIONS

International Search Report dated Jun. 14, 2016 issued in corresponding PCT Application PCT/US2016/057839.
(Continued)

*Primary Examiner* — Edward F Landrum
*Assistant Examiner* — Chang H. Park
(74) *Attorney, Agent, or Firm* — Norton Rose Fulbright US LLP

(57) ABSTRACT

A heat pump includes a control device configured to control conduction and shutting-off of electric power to a first compressor heater, and to control whether or not an alarm unit notifies an alarm. The control device causes the alarm unit to notify the alarm when the control device determines that duration of electric conduction to the first compressor heater is a predetermined period or longer. With this, it is possible to provide a heat pump that can control electric conduction to the heater to enable saving of electricity, and that can detect a problem in the controlling of the electric conduction to the heater.

20 Claims, 5 Drawing Sheets

(51) Int. Cl.

| | |
|---|---|
| ***F25B 43/00*** | (2006.01) |
| ***F25B 43/02*** | (2006.01) |
| ***F25B 49/00*** | (2006.01) |
| ***F25B 13/00*** | (2006.01) |

(52) U.S. Cl.
CPC ..... *F25B 49/005* (2013.01); *F25B 13/00* (2013.01); *F25B 49/022* (2013.01); *F25B 2313/0253* (2013.01); *F25B 2400/01* (2013.01); *F25B 2500/26* (2013.01); *F25B 2500/28* (2013.01)

(58) Field of Classification Search
CPC ..... F25B 49/022; F25B 2400/01; F25B 2500/26; F25B 2500/28
See application file for complete search history.

(56) References Cited

U.S. PATENT DOCUMENTS

| | | | | |
|---|---|---|---|---|
| 4,574,871 | A | 3/1986 | Parkinson et al. | |
| 5,012,652 | A | 5/1991 | Dudley | |
| 5,396,776 | A | 3/1995 | Kim | |
| 2002/0129612 | A1* | 9/2002 | Saikusa | F25B 31/002 62/192 |
| 2003/0089493 | A1* | 5/2003 | Takano | B60H 1/00914 165/202 |
| 2006/0107687 | A1* | 5/2006 | Chang | F25B 43/02 62/470 |
| 2013/0115063 | A1 | 5/2013 | Waller | |

FOREIGN PATENT DOCUMENTS

| | | | |
|---|---|---|---|
| CN | 202056027 | U | 11/2011 |
| CN | 103089577 | A | 5/2013 |
| CN | 203516011 | U | 4/2014 |
| CN | 104389759 | A | 3/2015 |
| JP | S61-043913 | A | 3/1986 |
| JP | 1987-156780 | A | 10/1987 |
| JP | 07-332818 | A | 12/1995 |
| JP | 11-102767 | A | 4/1999 |
| JP | 2005-118587 | A | 5/2005 |
| JP | 3962739 | B2 | 8/2007 |
| JP | 2008-286419 | A | 11/2008 |
| KR | 10-0152286 | B1 | 11/1998 |

OTHER PUBLICATIONS

European Search Report dated Jul. 9, 2018 issued in corresponding European Application No. 16764908.6.
Korean Office Action dated Nov. 9, 2018 issued in corresponding Korean Application No. 10-2017-7025615.
Chinese Office Action dated Apr. 29, 2019 issued in corresponding Chinese Application No. 201680007057.1.

* cited by examiner

HEAT PUMP

CROSS REFERENCES TO RELATED APPLICATIONS

This application is a national stage application pursuant to 35 U.S.C. § 371 of International Application No. PCT/JP2016/057839, filed on Mar. 11, 2016, which claims priority under 35 U.S.C. § 119 to Japanese Patent Application No. 2015-053177, filed on Mar. 17, 2015, the disclosures of which are hereby incorporated by reference in their entireties.

TECHNICAL FIELD

The present invention relates to a heat pump.

BACKGROUND ART

Traditionally, in a heat pump, there has been known that presence of liquid refrigerant around a compressor at a time of starting the compressor may cause a damage to the compressor by the refrigerant. Further, in order to restrain this issue, there has been known such technology that a heater is provided to the compressor, and while a time taken before starting of electric conduction to the heater is made short in cases where the external air temperature at a time of stopping the compressor is low, the time taken before starting of electric conduction to the heater is made long or no electric conduction to the heater is performed in cases where the external temperature at the time of stopping the compressor is high (see for example PTL 1). This technology adjusts standby period until the electric conduction to the heater is started based on the external air temperatures, and therefore enables saving of electricity.

CITATION LIST

Patent Literature

PTL 1: Japanese Patent Application Laid-Open No. 2008-286419

SUMMARY OF INVENTION

Technical Problem

In the above-described traditional art however has no counter measures for addressing situations where a problem takes place in a switching circuit and the like necessary for controlling electric conduction to the heater. Therefore, when a problem takes place in the switching circuit and the like, the compressor may be damaged by the liquid refrigerant.

In view of the above, it is an object of the present invention to provide a heat pump which is capable of detecting a problem in controlling electric conduction to a heater, while being capable of controlling the electric conduction to the heater to enable saving of electricity.

Solution to Problem

To achieve the above object, a heat pump of an embodiment of the present invention includes:

a compressor;

a compressor heater configured to warm the compressor;

an alarm unit configured to provide an alarm notification; and a control device configured to control conduction and shutting-off of electric power to the compressor heater, and to control whether or not the alarm unit provides the alarm notification, wherein the control device causes the alarm unit to provide the alarm notification when the control device determines that duration of electric conduction to the compressor heater is a predetermined period or longer.

Advantageous Effects of Invention

With the present invention, it is possible to control electric conduction to a heater to enable saving of electricity, and to detect a problem in the controlling of the electric conduction to the heater.

DESCRIPTION OF EMBODIMENTS

Figure 1:
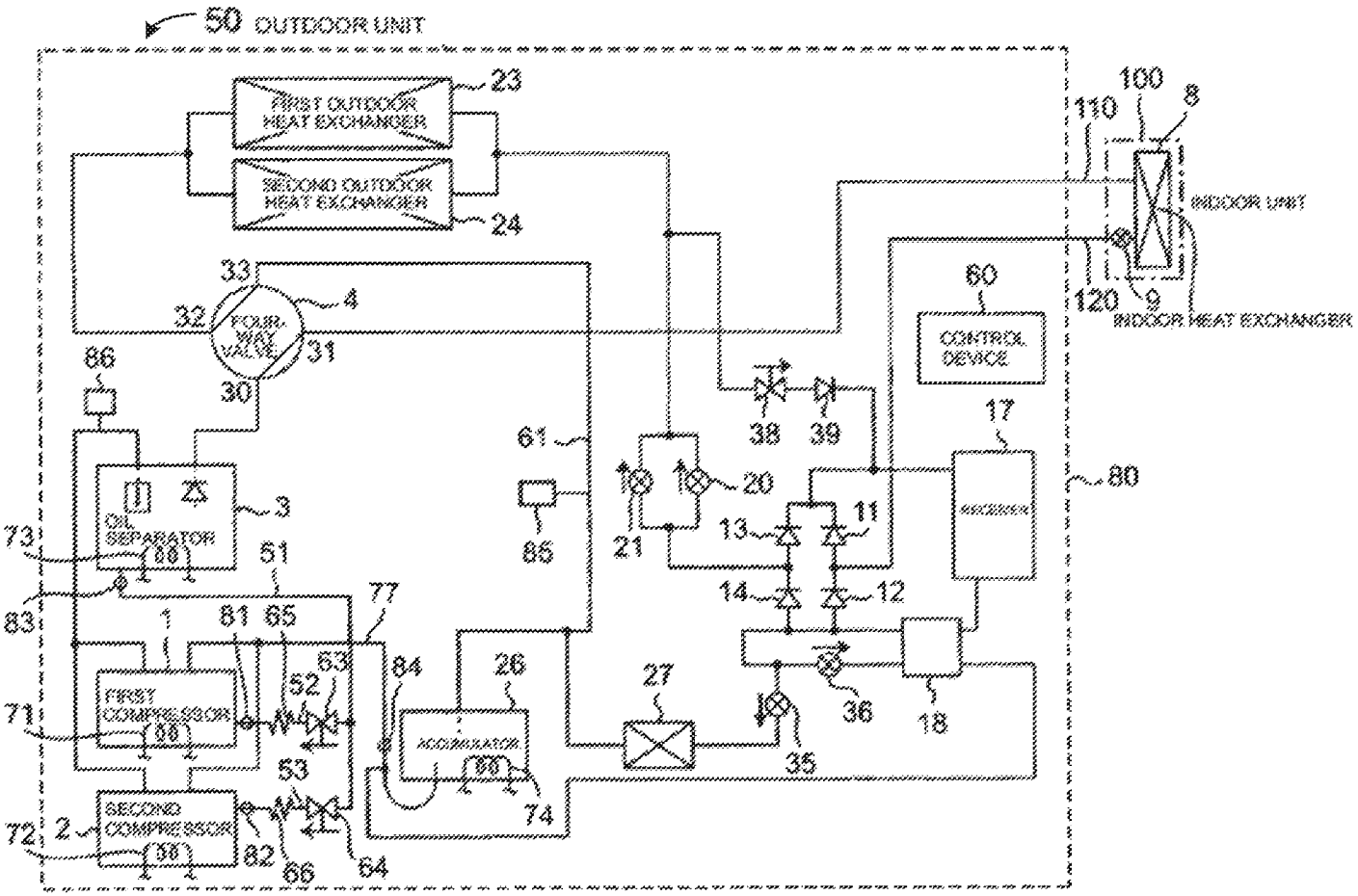
FIG. 1 A simplified refrigerant circuit diagram of a heat pump of an embodiment, according to the present invention.

A heat pump of a first mode of the present invention includes: a compressor; a compressor heater configured to warm the compressor; an alarm unit configured to provide an alarm notification; and a control device configured to control conduction and shutting-off of electric power to the compressor heater, and to control whether or not the alarm unit provides the alarm notification, wherein the control device causes the alarm unit to provide the alarm notification when the control device determines that duration of electric conduction to the compressor heater is a predetermined period or longer.

For Example, in cases of performing electric conduction to the heater at the time of starting the compressor so the temperature of the compressor becomes a necessary temperature based on the external air temperature, the quantity of heat necessary for achieving such a temperature of the compressor can be calculated because the thermal radiation performance of the compressor heater and the heat capacity of the compressor are known. Therefore, duration of electric conduction can be calculated and the duration of electric conduction is not a predetermined period or longer, usually. Thus, if the duration of electric conduction is the predetermined period or longer, for example, it is possible to detect a problem of not being able to drive the compressor heater such as disconnection, disengagement of connectors, and the like.

With this structure, the control device causes the alarm unit to provide an alarm notification if the duration of electric conduction to the compressor heater is the predetermined period or longer, an occurrence of a problem such as disconnection and disengagement of connectors and the like can be detected by the alarm notification. Thus, it is possible to control electric conduction to the compressor heater to enable saving of electricity, and to detect a problem in the controlling of the electric conduction to the compressor heater.

A heat pump of a second mode of the present invention may be the first mode, further including an oil separator provided in an ejection path of the compressor; and a separator heater configured to warm the oil separator, wherein the control device controls conduction and shutting-off of electric power to the separator heater, and the control device causes the alarm unit to provide the alarm notification when the control device determines that duration of electric conduction to the separator heater is a predetermined period or longer.

With this structure, it is possible to control electric conduction to the separator heater to enable saving of electricity, and to detect a problem in the controlling of the electric conduction to the separator heater.

A heat pump of a third mode of the present invention may be the first or the second mode, further including an accumulator provided in an inlet path of the compressor; and an accumulator heater configured to warm the accumulator, wherein the control device controls conduction and shutting-off of electric power to the accumulator heater, and the control device causes the alarm unit to provide the alarm notification when the control device determines that duration of electric conduction to the accumulator heater is a predetermined period or longer.

With this structure, it is possible to control electric conduction to the accumulator heater to enable saving of electricity, and to detect a problem in the controlling of the electric conduction to the accumulator heater.

In the following, the present invention is described in detail with reference to the illustrated embodiments.

FIG. 1 is a simplified refrigerant circuit diagram of a heat pump of an embodiment, according to the present invention.

This heat pump is configured to be driven by a gas engine. As shown in FIG. 1, the heat pump includes an outdoor unit 50, an indoor unit 100, a gas refrigerant pipe 110 and a liquid refrigerant pipe 120. It should be noted that the dotted line denoted by 80 in FIG. 1 indicates a package of the outdoor unit 50. As shown in FIG. 1, the gas refrigerant pipe 110 and the liquid refrigerant pipe 120 each connect the outdoor unit 50 with the indoor unit 100.

The outdoor unit 50 includes: a first compressor 1, a second compressor 2, an oil separator 3, a four-way valve 4, a first check valve 11, a second check valve 12, a third check valve 13, a fourth check valve 14, a receiver 17, and a supercooling heat exchanger 18. Further, the outdoor unit 50 includes: a first electronic expansion valve 20, a second electronic expansion valve 21, a first outdoor heat exchanger 23, a second outdoor heat exchanger 24, an accumulator 26, a refrigerant auxiliary evaporator 27, a third electronic expansion valve 35, a fourth electronic expansion valve 36, an electromagnetic valve 38, and a fifth check valve 39. On the other hand, the indoor unit 100 includes an indoor heat exchanger 8 and a fifth electronic expansion valve 9.

The control device 60 outputs control signals to the first compressor 1, the second compressor 2, the four-way valve 4, the first electronic expansion valve 20, the second electronic expansion valve 21, the third electronic expansion valve 35, the fourth electronic expansion valve 36, the fifth electronic expansion valve 9, and the electromagnetic valve 38, and controls these units. Although illustration is omitted, the control device 60 is electrically connected to these units through signal lines.

This heat pump performs cooling and heating operations as follows. First, in a heating operation, the control device 60 controls the four-way valve 4 to connect a first port 30 to a second port 31 of the four-way valve 4, and connects a third port 32 to a fourth port 33 of the four-way valve 4.

In the heating operation, a high-pressure gas refrigerant ejected from the compressors 1 and 2 first flow into the oil separator 3. The oil separator 3 separates lubricant oil of the compressors 1 and 2 from the gas refrigerant. In the FIG. 1, the reference numerals 51, 52, and 53 denote lines for returning to the compressors 1 and 2, the lubricant oil separated from the gas refrigerant in the oil separator 3. The line 51 connected to the oil separator 3 is branched into line 52 and line 53. While the line 52 is connected to an oil reservoir of the first compressor 1, the line 53 is connected to an oil reservoir of the second compressor 2. It should be noted that, in FIG. 1, the reference numeral 63 denotes an electromagnetic valve configured to control a flow of the lubricant oil from the oil separator 3 to the oil reservoir of the first compressor 1, and the reference numeral 64 denotes an electromagnetic valve configured to control a flow of the lubricant oil from the oil separator 3 to the oil reservoir of the second compressor 2. Further, the reference numeral 65 denotes a capillary which causes a drop in the pressure of gas refrigerant flowing towards the first compressor 1 through the line 52, and the reference numeral 66 denotes a capillary which causes a drop in the pressure of gas refrigerant flowing towards the second compressor 2 through the line 52.

In a heating operation, the gas refrigerant sequentially passes the oil separator 3 and the four-way valve 4 and flows into the indoor heat exchanger 8. The gas refrigerant gives heat to the indoor heat exchanger 8 and is liquefied into a liquid refrigerant. In the heating operation, the fifth electronic expansion valve 9 is controlled to be full-open by the control device 60. The liquid refrigerant having been liquefied after giving heat to the indoor heat exchanger 8 flows into the receiver 17 via the first check valve 11.

The receiver 17 plays a role of storing the liquid refrigerant. Then, the liquid refrigerant exits from a bottom portion of the receiver 17, passes the supercooling heat exchanger 18, passes the fourth check valve 14, and flows towards the first and the second electronic expansion valves 20 and 21.

It should be noted that, due to pressure drop in the path, the pressure of the liquid refrigerant having exited from the bottom of the receiver 17 is lower than the pressure of the liquid refrigerant on a flow-out side of the second check valve 12 or the pressure of the liquid refrigerant on flow-out sides of the first and the third check valves 11 and 13. This way, the liquid refrigerant having exited from the bottom of the receiver 17 basically does not pass the second check valve 12 or the third check valve 13.

Then, the liquid refrigerant is expanded, atomized into mist in the first and the second electronic expansion valve 20 and 21. The openings of the first and the second electronic expansion valves 20 and 21 are freely controllable by the control device 60, and the openings of the first and second electronic expansion valves 20 and 21 are suitably controlled by the control device 60. It should be noted that, while the pressure of the refrigerant before passing the first and the second electronic expansion valves 20 and 21 is high, the pressure of the same becomes low after passing the first and the second electronic expansion valves 20 and 21.

Then, the liquid refrigerant in the form of moist mist is subjected to heat exchanging with the external air and receives heat from the external air to be gasified, in the first and the second outdoor heat exchanger 23 and 24. As described, while the refrigerant gives heat to the indoor heat exchanger 8, it receives heat from the outdoor heat exchangers 23 and 24. Then, the gasified refrigerant passes the four-way valve 4 and reaches the accumulator 26. The accumulator 26 separates the gas refrigerant and mist refrigerant from each other, and completely gasify the refrigerant. If the refrigerant in the form of the mist returns to the compressors 1 and 2, the slide portions of the compressors 1 and 2 may be damaged. The accumulator 26 also plays a role of preventing such a situation. Then, the gas refrigerant having passed the accumulator 26 flows into inlet ports of the compressors 1 and 2.

By adjusting the opening of the third electronic expansion valve 35 under control by the control device 60, the liquid refrigerant having passed the supercooling heat exchanger 18 partially flows into the refrigerant auxiliary evaporator 27, after being turned into mist in the third electronic expansion valve 35. To the refrigerant auxiliary evaporator 27, a gas engine cooling water (temperature range from 60° C. to 90° C.) flows.

The liquid refrigerant in the form of mist having flown into the refrigerant auxiliary evaporator 27 is subjected to heat exchanging with the engine cooling water to turn into gas, and then reaches the accumulator 26.

Next, the cooling operation is described. In the cooling operation, the control device 60 controls the four-way valve 4 to connect the first port 30 to the third port 32 of the four-way valve 4, and connect the second port 31 to the fourth port 33 of the four-way valve 4. For a case of cooling, the flow of heat is simply described hereinbelow.

In cases of cooling operation, gas refrigerant ejected from the first and the second compressors 1 and 2 passes the oil separator 3, and then passes the four-way valve 4, and reaches the first and second outdoor heat exchanger 23 and 24. At this time, the temperature of the refrigerant is high, and therefore the refrigerant is cooled in the first and the second outdoor heat exchanger 23 and 24, even with the air of intense heat of the summer (with the air of 30 to 40° C.). The heat is taken from the gas refrigerant in the first and the second outdoor heat exchanger 23 and 24, thus turning into liquid refrigerant.

In the cooling operation, the control device 60 controls the opening of the first and the second electronic expansion valves 20 and 21 to a suitable opening, and controls the electromagnetic valve 38 to be full-open. The liquid refrigerant having passed the first and the second outdoor heat exchangers 23 and 24 basically passes the electromagnetic valve 38 and the check valve 39, and reaches the receiver 17. Then, the liquid refrigerant exits from the bottom of the receiver 17, passes the supercooling heat exchanger 18, and flows from a portion between the second check valve 12 and the first check valve 11 towards the fifth electronic expansion valve 9.

The opening of the fifth electronic expansion valve 9 is freely controllable, and the opening of the fifth electronic expansion valve 9 is controlled so that the degree of superheat on the side of the gas refrigerant pipe 110 of the indoor heat exchanger 8 is maintained at a targeted degree of superheat. The mist of the low temperature liquid refrigerant having flown into the indoor heat exchanger 8 takes away the heat from the indoor heat exchanger 8 to cool down the indoor air, and on the other hand, the refrigerant is gasified by the heat given from the indoor heat exchanger 8. As described, while the refrigerant takes away heat from the indoor heat exchanger 8, it radiates the heat to the first and the second outdoor heat exchanger 23 and 24. Then, the gasified gas refrigerant sequentially passes the four-way valve 4 and the accumulator 26, and flows into the inlet port of the compressors 1 and 2.

Further, by adjusting the opening of the fourth electronic expansion valve 36 under control by the control device 60, the liquid refrigerant having passed the receiver 17 and the supercooling heat exchanger 18 is partially decompressed and expanded by the fourth electronic expansion valve 36 and flows into the supercooling heat exchanger 18. This way, heat exchanging is performed between the liquid refrigerant from the receiver 17 flown into the supercooling heat exchanger 18 without going through the fourth electronic expansion valve 36 and the liquid refrigerant flown into the supercooling heat exchanger 18 through the fourth electronic expansion valve 36. Then, while the liquid refrigerant to be fed to the indoor heat exchanger 8 is further cooled, the liquid refrigerant having passed the fourth electronic expansion valve 36 is gasified by warming, and fed towards the compressors 1 and 2.

As shown in FIG. 1, the heat pump further includes: a first compressor heater 71; a second compressor heater 72; a separator heater 73, an accumulator heater 74, a first temperature sensor 81, a second temperature sensor 82, a third temperature sensor 83, a fourth temperature sensor 84, a pressure sensor 85, and a pressure sensor 86.

The first compressor heater 71 is provided in the oil reservoir of the first compressor 1, and is configured to warm the first compressor 1. The second compressor heater 72 is provided in the oil reservoir of the second compressor 2 and is configured to warm the second compressor 2. Further, the separator heater 73 is configured to warm the oil separator 3 and is provided in a lower position than an oil extraction port of the oil separator 3 relative to the vertical direction while the oil separator 3 is in an in-use state. Further, the accumulator heater 74 is configured to warm the accumulator 26 and is provided in a lower position than a gas refrigerant extraction port of the accumulator 26 relative to the vertical direction while the accumulator 26 is in an in-use state.

As shown in FIG. 1, the first temperature sensor 81 is provided in the line 52 for returning the oil to the first compressor 1, in the vicinity of the first compressor 1. The first temperature sensor 81 is capable of measuring the temperature of the first compressor 1. Further, the second temperature sensor 82 is provided in the line 53 for returning the oil to the second compressor 2, in the vicinity of the second compressor 2. The second temperature sensor 82 is capable of measuring the temperature of the second compressor 2. Further, the third temperature sensor 83 is provided in the line 51 for returning the oil from the oil separator 3 to the compressors 1 and 2, in the vicinity of the oil separator 3. The third temperature sensor 83 is capable of measuring the temperature of the oil separator 3.

The pressure sensor 85 is provided in a line 61 through which gas refrigerant from the four-way valve 4 returns to the accumulator 26, and detects the air pressure of the gas refrigerant passing the line 61. Further, the fourth temperature sensor 84 is provided in a line 77 through which gas refrigerant from the accumulator 26 returns to the compressors 1 and 2, and detects the temperature of the gas refrigerant passing the line 77.

The pressure sensor 85 and the fourth temperature sensor 84 are each configured to output signals to the control device 60. The control device 60 calculates the saturated steam temperature of the gas refrigerant passing the line 61 based on a signal from the pressure sensor 85. Then, based on this saturated steam temperature and the temperature of the gas refrigerant passing the line 77, which temperature is detected based on the signal from the fourth temperature sensor 84, the degree of superheat is calculated, and the liquid refrigerant is reliably prevented from returning to the compressors 1 and 2 to reliably prevent damages to the compressors 1 and 2 which could be caused by the liquid refrigerant returned.

The fourth temperature sensor 84 is provided for the purpose of calculating the degree of superheat; however, the fourth temperature sensor 84 is provided in the vicinity of the accumulator 26. Therefore, the temperature detected by the fourth temperature sensor 84 can be also used as a substitute temperature for the temperature of the accumulator 26.

Although illustration is omitted, the heat pump includes: a circuit configured to perform conduction and shutting-off of electric power to the first compressor heater 71; a circuit configured to perform conduction and shutting-off of electric power to the second compressor heater 72; a circuit configured to perform conduction and shutting-off of electric power to the separator heater 73; and a circuit configured to perform conduction and shutting-off of electric power to the accumulator heater 74. The control device 60 outputs control signals to a switching element of each circuit, which serve as a controlling unit for conduction and shut-off to the heater, thereby to control driving and stopping of the heaters 71 to 74.

Figure 2:
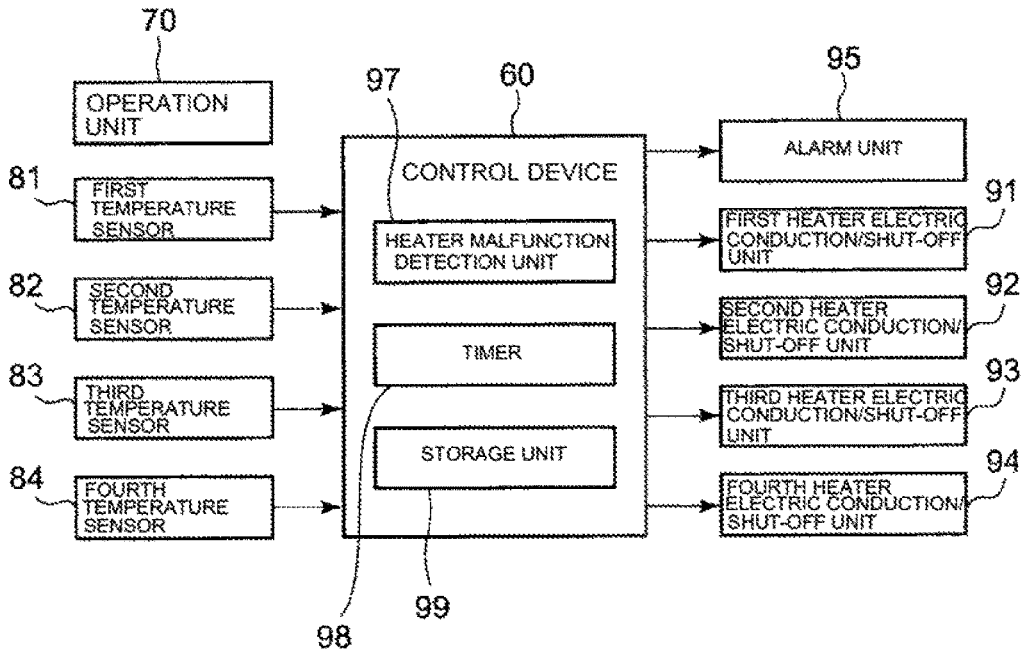
FIG. 2 A block diagram of a control device of the heat pump.

FIG. 2 is a block diagram of the control device 60.

It should be noted that the block diagram of FIG. 2 only illustrates parts related to heater control, and illustration of the parts related to other control are omitted.

As shown in FIG. 2, while signals representing temperatures are input to the control device 60 from each of the first to fourth temperature sensors 81 to 84, the control device 60 outputs control signals to first to fourth heater conduction/shut-off units 91 to 94 (switching elements for performing conduction and shutting-off of electric power to the heaters 71 to 74). Further, to the control device 60, signals from an operation unit 70 constituted by a remote-controller and the like are input.

The control device 60 includes a heater malfunction detection unit 97, a timer 98, and a storage unit 99. Suppose that electric conduction to the heaters 71 to 74 of the first compressor 1, the second compressor 2, the oil separator 3, and the accumulator 26 is stopped. The thermal radiation performances of the heaters 71 to 74 as well as the heat capacities of the devices 1, 2, 3, and 26 are known. Therefore, if the temperatures of the devices 1, 2, 3, and 26 are known, it is possible to set the maximum required heat capacities of the heaters 71 to 74 for making the temperatures of the devices 1, 2, 3, and 26 such that a targeted degree of superheat is achieved, and to recognize the maximum required durations of electric conduction for each temperature of the devices 1, 2, 3, and 26. The storage unit 99 stores therein in advance temperatures of devices 1, 2, 3, and 26 and the maximum required durations of electric conduction on a one-by-one basis, for each of the devices 1, 2, 3, and 26.

Further, the alarm unit 95 is constituted by a monitor. The heater malfunction detection unit 97 of the control device 60 is capable of performing control to cause the alarm unit 95 to provide an alarm notification of failure, for each of the heaters 71 to 74. More specifically, based on a signal from the first temperature sensor 81 which represents the temperature of the first compressor 1, the heater malfunction detection unit 97 retrieves from the storage unit 99 the maximum required electric conduction period corresponding to the temperature of the first compressor 1, and causes the alarm unit 95 to present text indicating failure of the first compressor heater 71 if the duration of the electric conduction period reaches the maximum required electric conduction period.

Likewise, based on a signal from the second temperature sensor 82 which represents the temperature of the second compressor 2, the heater malfunction detection unit 97 retrieves from the storage unit 99 the maximum required electric conduction period corresponding to the temperature of the second compressor 2, and causes the alarm unit 95 to present text indicating failure of the second compressor heater 72 if the duration of the electric conduction period reaches the maximum required electric conduction period.

Further, based on a signal from the third temperature sensor 83 which represents the temperature of the oil separator 3, the heater malfunction detection unit 97 retrieves from the storage unit 99 the maximum required electric conduction period corresponding to the temperature of the oil separator 3, and causes the alarm unit 95 to present text indicating failure of the separator heater 73 if the duration of the electric conduction period reaches the maximum required electric conduction period.

Further, based on a signal from the fourth temperature sensor 84 which represents the temperature of the accumulator 26, the heater malfunction detection unit 97 retrieves from the storage unit 99 the maximum required electric conduction period corresponding to the temperature of the accumulator 26, and causes the alarm unit 95 to present text indicating failure of the accumulator heater 74 if the duration of the electric conduction period reaches the maximum required electric conduction period.

Figure 3:
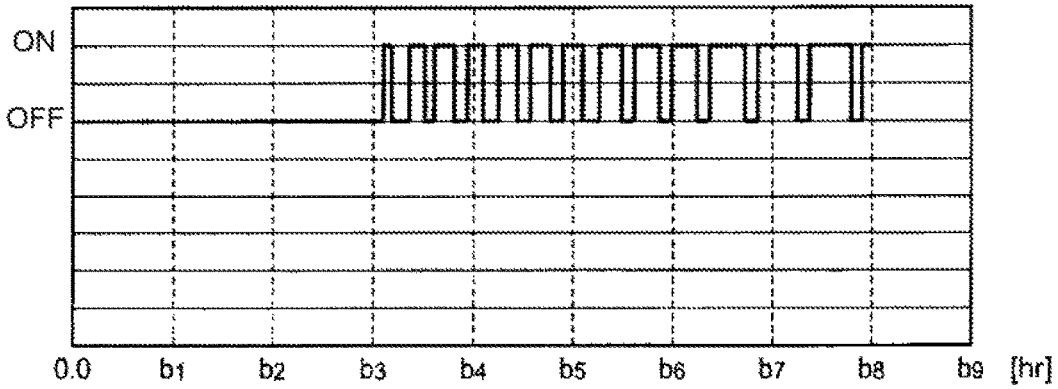
FIG. 3 A diagram showing an example of how ON/OFF of driving for a first compressor heater is performed with respect to time, in cases where power from a gas engine to a second compressor is shut-off, while the first compressor is driven.
Figure 4:
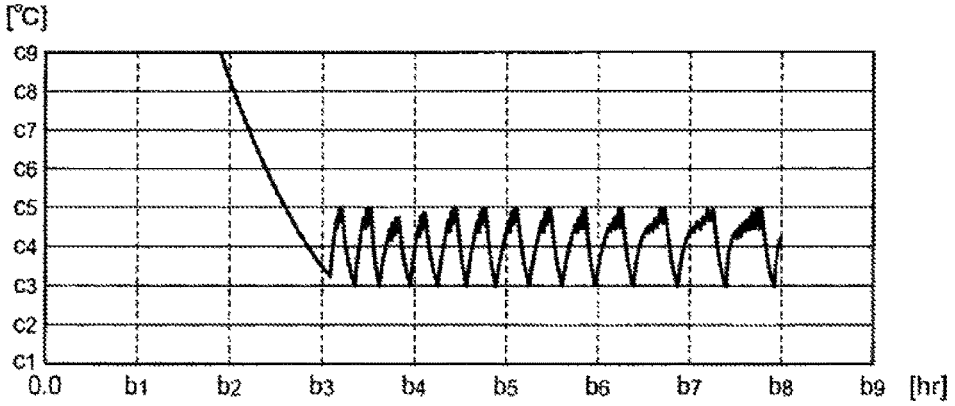
FIG. 4 A diagram showing an example how degree of superheat fluctuates with respect to time, in a place where a first temperature sensor is installed, in the example shown in FIG. 3.

FIG. 3 shows an example of driving of the second compressor heater 72 while the first compressor 1 is stopped and the second compressor 2 is stopped. Further, FIG. 4 shows chronological transition of the degree of superheat with respect to time at a position of installing the second temperature sensor 82, in the example of FIG. 3. It should be noted that the degree of superheat related to the second compressor heater 72 is a temperature differential between a temperature detected by the second temperature sensor 82 and a saturated steam temperature which is determined based on a pressure detected by the pressure sensor 85.

In FIG. 3, the transverse axis indicates time [hr], and the vertical axis indicates ON/OFF of the heater. Further, in FIG. 4, the transverse axis indicates time [hr], and the vertical axis indicates the degree of superheat [° C.]. Further, the time points represented by b1 to b9 of FIG. 3 are identical to those represented by b1 to b9 of FIG. 4. As shown in FIG. 3 and FIG. 4, when the second compressor heater 72 is driven, the degree of superheat at the position of installing the second temperature sensor 82 correspondingly rises monotonically with elapse of time (e.g., C3<C5). Further, when the second compressor heater 72 is stopped, the degree of superheat at the position of installing the second temperature sensor 82 correspondingly drops monotonically with elapse of time (e.g., C5>C3). The similar phenomenon is confirmed also in the other heaters 73 and 74 as indicated below.

Figure 5:
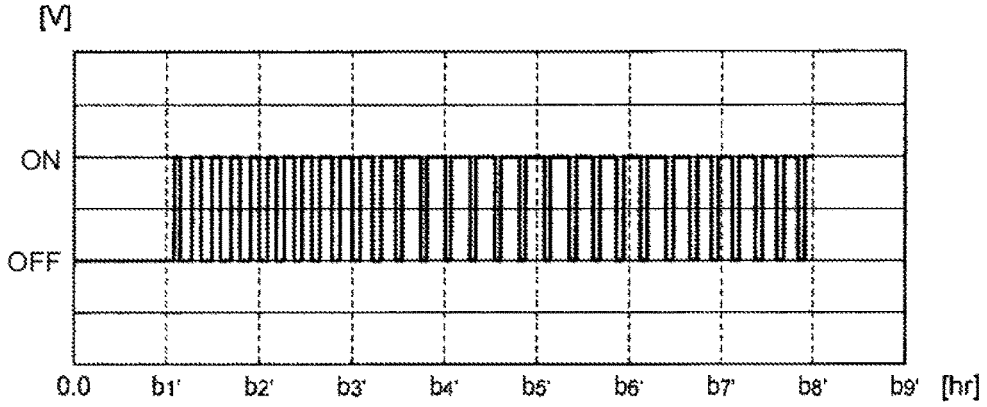
FIG. 5 A diagram showing an example of how ON/OFF of driving for a separator heater is performed.
Figure 6:
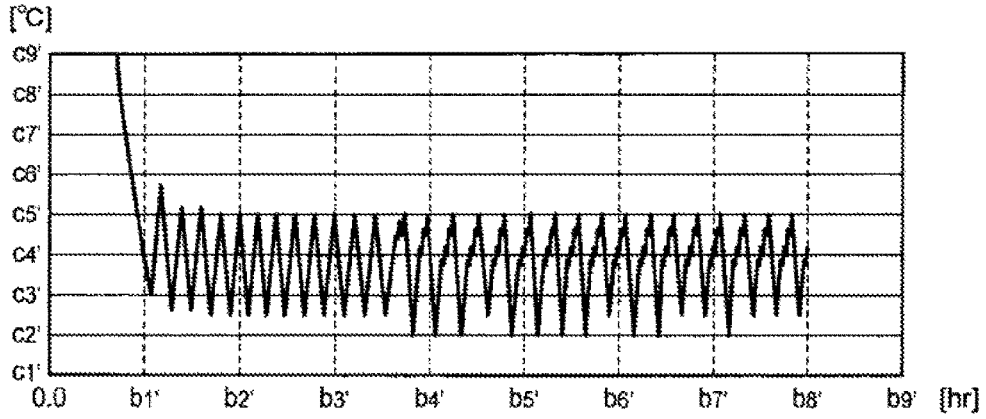
FIG. 6 A diagram showing an example how degree of superheat fluctuates with respect to time, in a place where a third temperature sensor is installed, in the example shown in FIG. 5.

FIG. 5 shows an example of driving of the separator heater 73. Further, FIG. 6 shows chronological transition of the degree of superheat with respect to time at a position of installing the third temperature sensor 83, in the example of FIG. 5. It should be noted that the degree of superheat related to the separator heater 73 is a temperature differential between a temperature detected by the third temperature sensor 83 and a saturated steam temperature which is determined based on a pressure detected by the pressure sensor 86.

In FIG. 5, the transverse axis indicates time [hr], and the vertical axis indicates ON/OFF of the heater. Further, in FIG. 6, the transverse axis indicates time [hr], and the vertical axis indicates the degree of superheat [° C.]. Further, the time points represented by b1' to b9' of FIG. 5 are identical to those represented by b1' to b9' of FIG. 6. As shown in FIG. 5 and FIG. 6, when the separator heater 73 is driven, the degree of superheat at the position of installing the third temperature sensor 83 correspondingly rises monotonically with elapse of time (e.g., C3'<C5'). Further, when the separator heater 73 is stopped, the degree of superheat at the position of installing the third temperature sensor 83 correspondingly drops monotonically with elapse of time (e.g., C5'>C3').

Figure 7:
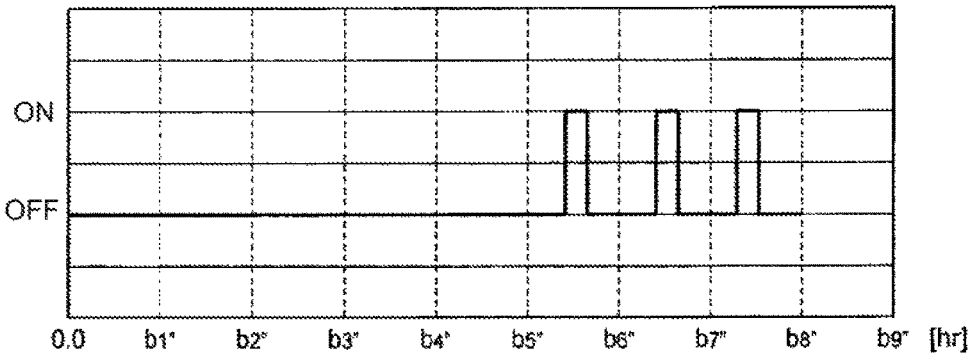
FIG. 7 A diagram showing an example of how ON/OFF of driving for an accumulator heater is performed.
Figure 8:
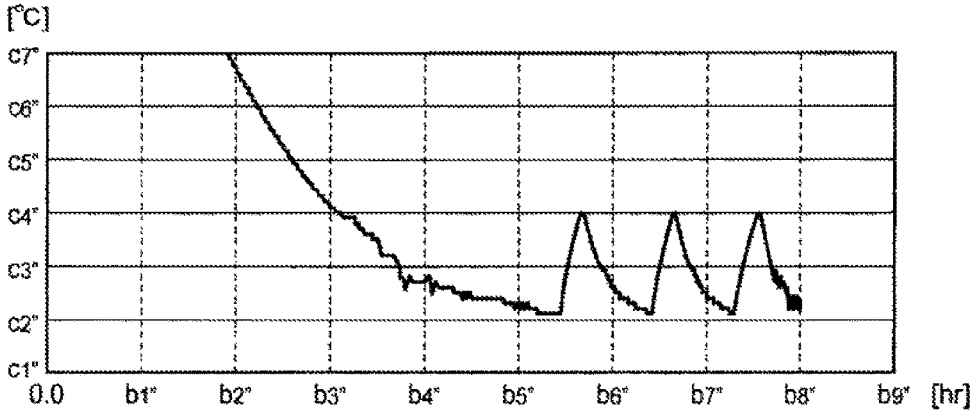
FIG. 8 A diagram showing an example how degree of superheat fluctuates with respect to time, in a place where a fourth temperature sensor is installed, in the example shown in FIG. 7.

FIG. 7 shows an example of driving of the accumulator heater 74. Further, FIG. 8 shows chronological transition of the degree of superheat with respect to time at a position of installing the fourth temperature sensor 84, in the example of FIG. 7. It should be noted that the degree of superheat related to the accumulator heater 74 is a temperature differential between a temperature detected by the fourth temperature sensor 84 and a saturated steam temperature which is determined based on a pressure detected by the pressure sensor 85.

In FIG. 7, the transverse axis indicates time [hr], and the vertical axis indicates ON/OFF of the heater. Further, in FIG. 8, the transverse axis indicates time [hr], and the vertical axis indicates the degree of superheat [° C.]. Further, the time points represented by b1" to b9" of FIG. 7 are identical to those represented by b1" to b9" of FIG. 8. As shown in FIG. 7 and FIG. 8, when the accumulator heater 74 is driven, the degree of superheat at the position of installing the fourth temperature sensor 84 correspondingly rises monotonically with elapse of time (e.g., C2"<C4"). Further, when the accumulator heater 74 is stopped, the degree of superheat at the position of installing the fourth temperature sensor 84 correspondingly drops monotonically with elapse of time (e.g., C4">C2").

Figure 9:
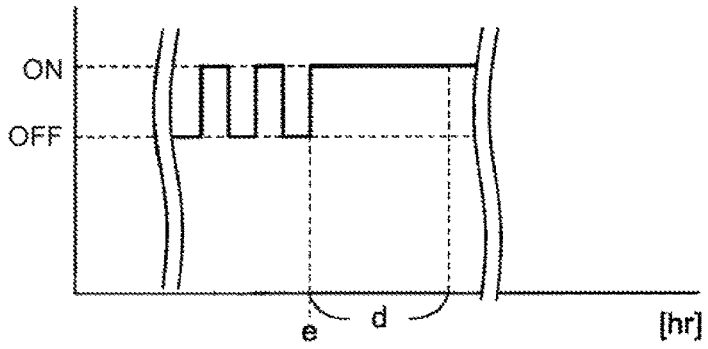
FIG. 9 A schematic diagram showing a waveform of voltage when the control device determines a problem in the first compressor heater, in the example shown in FIG. 1 and FIG. 2.

FIG. 9 is a schematic diagram showing a waveform of voltage when the control device 60 determines a problem in the first compressor heater 71, in the example shown in FIG. 1 and FIG. 2. It should be noted that, in FIG. 9, d[hr] is the maximum required duration of electric conduction specified by the control device 60 based on a signal from the first temperature sensor 81 at the time point e. Further, in FIG. 9, the vertical axis represents ON/OFF of the heater.

In the example shown in FIG. 9, the electric conduction to the first compressor heater 71 is performed for a period which equals to or longer than d which is the maximum required duration of electric conduction specified by the control device 60. In this case, the control device 60 causes the alarm unit 95 to provide a notification of failure of the first compressor heater 71.

Figure 10:
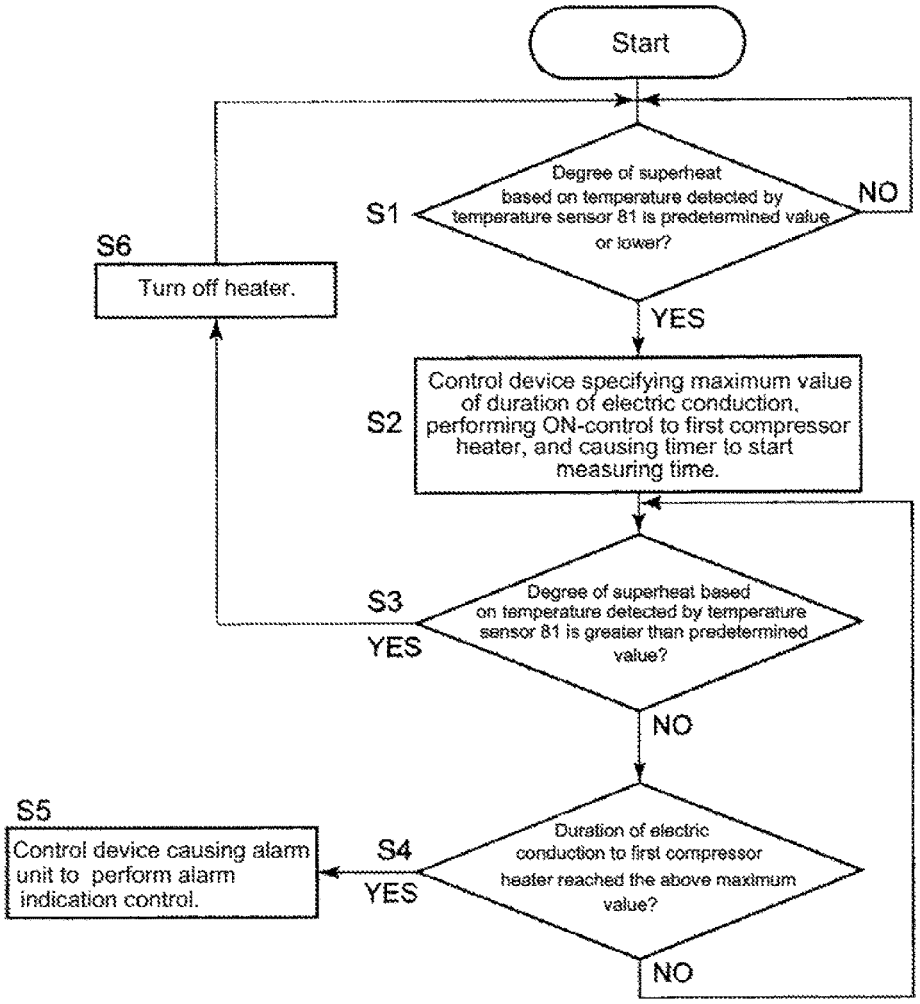
FIG. 10 A flowchart showing an exemplary control of a first compressor heater by the control device.

FIG. 10 is a flowchart showing an exemplary control of a first compressor heater 71 by the control device 60. It should be noted that the second compressor heater 72, the separator heater 73, and the accumulator heater 74 are also controlled in the similar manner according to the flow described with reference to FIG. 10. Since replacing the reference numeral of the temperature sensor 81 with 82, 83 or 84 respectively corresponds to the flowchart for the second compressor heater 72, the separator heater 73 or the accumulator heater 74, the description of these control flows is omitted.

Referring to FIG. 10, when control starts after the heat pump is stopped, the control device 60 determines in step S1 whether or not the degree of superheat based on the temperature detected by the temperature sensor 81 is a predetermined value or lower. When the degree of superheat is greater than the predetermined value, the determination in step S1 is repeated at a predetermined cycle, and when the degree of superheat is the predetermined value or lower, the process proceeds to step S2.

In step S2, the control device 60 specifies the maximum value of the duration of electric conduction, an ON-control is performed to the first compressor heater 71, and measurement of time by the timer 98 is started.

Then, the process proceeds to step S3, and the control device 60 determines whether or not the degree of superheat based on the temperature detected by the temperature sensor 81 is greater than the predetermined value. The process proceeds to step S4 if the degree of superheat is the predetermined value or lower, and if the degree of superheat is greater than the predetermined value, the process proceeds to step S6 to turn off the heater, and then the process returns to step S1.

In step S4, the control device 60 determines whether or not the duration of electric conduction to the first compressor heater 71 has reached the maximum value of duration of electric conduction specified in step S2. If the control device 60 determines that the duration of electric conduction to the first compressor heater 71 has not yet reached the maximum value of duration of electric conduction specified in step S2, the process returns to step S3.

On the other hand, in step S4, if the control device 60 determines that the duration of electric conduction to the first compressor heater has reached the maximum value of duration of electric conduction specified in step S2, the process proceeds to step S5.

In step S5, the control device 60 causes the alarm unit 95 to provide a notification of failure of the first compressor heater 71.

In the above embodiment, because the control device 60 causes the alarm unit 95 to provide, for each of the devices 1, 2, 3, and 26, an alarm notification if the duration of electric conduction to any of the heaters 71 to 74 reaches or exceeds a predetermined period (maximum values of duration of electric conduction) which is determined for each of the devices 1, 2, 3, and 26, an occurrence of a problem such as disconnection and disengagement of connectors and the like in the devices 1, 2, 3, and 26 can be detected by the alarm notification. Thus, it is possible to control electric conduction to each of the heaters 71 to 74 to enable saving of electricity, and to detect a problem in the controlling of the electric conduction to any of the compressor heaters 71 to 74.

It should be noted that, in the above embodiment, there are separator heater 73 and the accumulator heater 74;

however, at least one of the separator heater and the accumulator heater may be omitted.

Further, in the above embodiment, the compressor heaters 71 and 72 are provided in the oil reservoirs of the compressors 1 and 2, respectively; however, each compressor heater may be provided in positions other than the oil reservoir of the compressor, and may be provided in a position distanced from the compressor. The compressor heater may be provided in any position as long as it can warm the compressor.

Further, in the above embodiment, the separator heater 73 is provided in a lower position than the oil extraction port of the oil separator 3 relative to the vertical direction while the oil separator 3 is in the in-use state. However, the separator heater may be provided at the same level as the oil extraction port of the oil separator in the in-use state, or in a higher position than the oil extraction port relative to the vertical direction. The separator heater may be provided in any position as long as it can warm the oil separator.

Further, in the above embodiment, the accumulator heater 74 is provided in a lower position than a gas refrigerant extraction port of the accumulator 26 relative to the vertical direction while the accumulator 26 is in the in-use state. However, the accumulator heater may be provided at the same level as the gas refrigerant extraction port of the accumulator in the in-use state, or in a higher position than the gas refrigerant extraction port relative to the vertical direction. The accumulator heater may be provided in any position as long as it can warm the accumulator.

Further, in the above embodiment, the alarm unit 95 is configured to indicate an alarm notification on a monitor; however, the alarm unit 95 may only output an alarm sound, without indication of the alarm on the monitor. Further, the alarm unit may be configured to only output signal representing an alarm to a specific device (e.g., to a remote monitoring system).

Further, in the above embodiment, the heat pump included two compressors 1 and 2; however, the heat pump may include only one compressor, and the heat pump may include only the first compressor heater, without the second compressor heater.

Further, in the above embodiment, the heat pump includes an indoor heat exchanger, and the heat pump served as an air conditioner; however, the heat pump may be a chiller that supplies at least one of warm water and cool water.

Further, in the above embodiment, the heat pump is driven by the gas engine. However, the heat pump may be driven by a gasoline engine, driven by a diesel engine, or driven by an electric motor.

Further, in the present invention, in comparison with the above embodiment whose structure is shown in FIG. 1, one or more electrical components or parts out of those constituting the above embodiment may be omitted as needed, based on the specification. Further, in the present invention, in comparison with the above embodiment whose structure is shown in FIG. 1, further electrical component or a part may be added to those constituting the above embodiment, based on the specification. It goes without saying that two or more structures out of the entire structure described in the above embodiments and modification may be combined to construct a new embodiment.

Preferred embodiments of the present invention are thus sufficiently described with reference to attached drawings; however, it is obvious for a person with ordinary skill in the art to which the present invention pertains that various modification and changes are possible. Such a modification and changes, unless they depart from the scope of the present invention as set forth in claims attached hereto, shall be understood as to be encompassed by the present invention.

The entire disclosure of the specification, drawings, and claims of Japanese patent application No. 2015-53177 filed on Mar. 17, 2015 is incorporated in this specification by reference.

REFERENCE SIGNS LIST

1 first compressor
2 second compressor
3 oil separator
26 accumulator
60 control device
70 operation unit
71 first compressor heater
72 second compressor heater
73 separator heater
74 accumulator heater
81 first temperature sensor
82 second temperature sensor
83 third temperature sensor
84 fourth temperature sensor
95 alarm unit
97 heater malfunction detection unit
98 timer
99 storage unit

The invention claimed is:

1. A heat pump comprising:
a compressor;
a compressor heater configured to warm the compressor; and
a controller configured to:
provide an output signal to initiate one or more alarm notifications,
control conduction and shutting-off of electric power to the compressor heater,
control whether or not an alarm provides at least one of the one or more alarm notifications, and
provide a first one of the one or more alarm notifications based on a determination, by the controller, that a degree of superheat related to the compressor heater is less than or equal to a predetermined value and that a duration of conduction of electric power to the compressor heater is greater than or equal to a first predetermined time period.

2. The heat pump according to claim 1, further comprising:
an oil separator provided in an ejection path of the compressor; and
a separator heater configured to warm the oil separator,
wherein the controller is configured to:
control conduction and shutting-off of electric power to the separator heater, and
provide a second one of the one or more alarm notifications based on a determination, by the controller, that a duration of conduction of electric power to the separator heater is greater than or equal to a second predetermined time period.

3. The heat pump according to claim 1, further comprising:
an accumulator provided in an inlet path of the compressor; and
an accumulator heater configured to warm the accumulator, wherein the controller is configured to:

control conduction and shutting-off of electric power to the accumulator heater, and provide a third one of the one or more alarm notifications based on a determination, by the controller, that a duration of conduction of electric power to the accumulator heater is greater than or equal to a third predetermined time period.

4. The heat pump according to claim 2, further comprising:

an accumulator provided in an inlet path of the compressor; and an accumulator heater configured to warm the accumulator, wherein the controller is configured to:

control conduction and shutting-off of electric power to the accumulator heater, and provide a third one of the one or more alarm notifications based on a determination, by the controller, that a duration of conduction of electric power to the accumulator heater is greater than or equal to a third predetermined time period.

5. The heat pump according to claim 1, wherein, to provide the at least one of the one or more alarm notifications, the controller is configured to output a signal corresponding to the one or more alarm notifications.

6. The heat pump according to claim 1, wherein the degree of superheat comprises a differential between a temperature of the compressor and a saturated steam temperature of a gas refrigerant in the heat pump.

7. The heat pump according to claim 1, further comprising:

a temperature sensor configured to determine a temperature associated with the compressor; and a pressure sensor configured to determine a pressure associated with a line through which gas refrigerant from a four-way valve is provided to an accumulator.

8. The heat pump according to claim 7, wherein the controller is further configured to:

determine a saturated steam temperature based on the pressure determined by the pressure sensor.

9. The heat pump according to claim 8, wherein the controller is further configured to:

determine the degree of superheat based on the saturated steam temperature and the temperature determined by the temperature sensor.

10. The heat pump according to claim 1, further comprising:

a monitor configured to provide the one or more alarm notifications;

a temperature sensor configured to determine a temperature associated with the compressor; and a pressure sensor configured to determine a pressure associated with a line coupled to the compressor and an oil separator.

11. The heat pump according to claim 10, wherein the controller is further configured to:

determine a saturated steam temperature based on the pressure determined by the pressure sensor.

12. The heat pump according to claim 11, wherein the controller is further configured to:

determine the degree of superheat based on the saturated steam temperature and the temperature determined by the temperature sensor.

13. A system comprising:

a controller of a heat pump, the controller configured to:

receive data indicative of a temperature associated with a compressor of the heat pump;

calculate a saturated steam temperature of a gas refrigerant associated with the heat pump;

determine a degree of superheat based on the temperature and the saturated steam temperature;

compare the degree of superheat to a first predetermined value;

determine a duration of electric conduction to a compressor heater that is configured to control the compressor;

compare the duration of electric conduction to the compressor heater to a second predetermined value; and initiate a first alarm in response to a determination that the degree of superheat is less than or equal to the first predetermined value and that the duration of electric conduction to the compressor heater is greater than or equal to the second predetermined value.

14. The system according to claim 13, wherein the controller is configured to control electric conduction of electric power to the compressor heater.

15. The system according to claim 13, wherein the controller is configured to shut off of electric power to the compressor heater.

16. The system according to claim 13, further comprising:

the compressor; and the compressor heater.

17. The system according to claim 13, further comprising:

an oil separator provided in an ejection path of the compressor; and a separator heater configured to heat the oil separator, wherein the controller is configured to:

determine a duration of electric conduction to the separator heater;

compare the duration of electric conduction to the compressor heater to a third predetermined value; and initiate a second alarm in response to a determination that the duration of electric conduction to the separator heater is greater than or equal to the third predetermined value.

18. The system according to claim 13, further comprising:

an accumulator provided in an inlet path of the compressor; and an accumulator heater configured to heat the accumulator, wherein the controller is configured to:

determine a duration of electric conduction to the accumulator heater;

compare the duration of electric conduction to the accumulator heater to a fourth predetermined value; and initiate a third alarm in response to a determination that the duration of electric conduction to the accumulator heater is greater than or equal to the fourth predetermined value.

19. A method of operating a heat pump, the method comprising:

determining, by the heat pump, a temperature associated with a compressor of the heat pump;

determining, by the heat pump, based on the temperature, a degree of superheat related to a compressor heater of the heat pump; and initiating, by the heat pump, an alarm in response to a determination that a degree of superheat is less than or equal to a first predetermined value and that a duration of electric conduction to the compressor heater is greater than or equal to a second predetermined value.

20. The method according to claim 19, further comprising:

calculating, by the heat pump a saturated steam temperature of a gas refrigerant associated with the heat pump, wherein the degree of superheat is further determined based on the saturated steam temperature;

comparing, by the heat pump, the degree of superheat to the first predetermined value;

determining, by the heat pump, the duration of electric conduction to the compressor heater; and comparing, by the heat pump, the duration of electric conduction to the compressor heater to the second predetermined value.

* * * * *